United States Patent [19]

Patyk et al.

[11] 4,248,145

[45] Feb. 3, 1981

[54] HIGH SPEED MARKING APPARATUS

[76] Inventors: Fred Patyk, 503 Kelly Ct, Lombard, Ill. 60148; Elbert F. T. Wessman, P.O. Box 109, New Lenox, Ill. 60451

[21] Appl. No.: 30,890

[22] Filed: Apr. 17, 1979

[51] Int. Cl.[3] ..... B41J 5/00

[52] U.S. Cl. ..... 101/77; 101/86; 101/87; 101/76

[58] Field of Search ..... 101/70, 72, 76, 77, 101/85, 86, 87, 88, 248; 74/395

[56] References Cited

U.S. PATENT DOCUMENTS

| | | | |
|---|---|---|---|
| 2,030,027 | 2/1936 | Greenwood | 74/395 |
| 2,900,898 | 8/1959 | Buttner | 101/72 X |
| 3,359,894 | 12/1967 | Rydman | 101/70 X |
| 3,525,305 | 8/1970 | Daniels | 101/248 X |
| 3,563,104 | 2/1971 | Schuster | 74/395 |
| 3,603,251 | 9/1971 | Elsworth et al. | 101/76 |
| 3,782,277 | 1/1974 | Neal | 101/76 |
| 4,024,812 | 5/1977 | Jahn | 101/76 |
| 4,068,578 | 1/1978 | Delligatti | 101/85 X |
| 4,068,582 | 1/1978 | Poitras et al. | 101/76 |

OTHER PUBLICATIONS

Draper et al., IBM Tech. Discl. Bulletin, vol. 19, No. 11, Apr. 1977, pp. 4393–4395.

*Primary Examiner*—Edward M. Coven
*Attorney, Agent, or Firm*—Thomas R. Vigil

[57] ABSTRACT

The apparatus is positioned at the exit end of a high speed printing machine having a cylindrical printing plate on a driven shaft. A framework of the apparatus is mounted to the exit end. A first shaft is journalled to the framework and indicia marking means are provided axially adjustable on and rotatable with the first shaft for marking selected indicia on material. Indicia changing means are provided for changing the indicia and actuating means selectively actuate the indicia changing means to change indicia after a number of revolutions of the first shaft. A second shaft is rotatably journalled to the framework parallel to the first shaft. A third shaft is pivotally mounted to the second shaft. A drive drivingly couples the second shaft to the third shaft. Pneumatic means are provided for moving an impression roller on the third shaft between a lower position and a raised position where the periphery of the impression roller has a tangent with the circular path of the indicia marking means. Drive means couple the driven shaft for the printing plate to the first and second shafts. The drive means include timing means for adjusting the time and position of the marking of indicia on the material relative to the time of printing on the material by the printing plate. Control means are provided for controlling the operation of the actuating means and the roller moving means and positioning means are provided for adjusting the axial position of the indicia marking means on the first shaft.

29 Claims, 7 Drawing Figures

FIG. 5
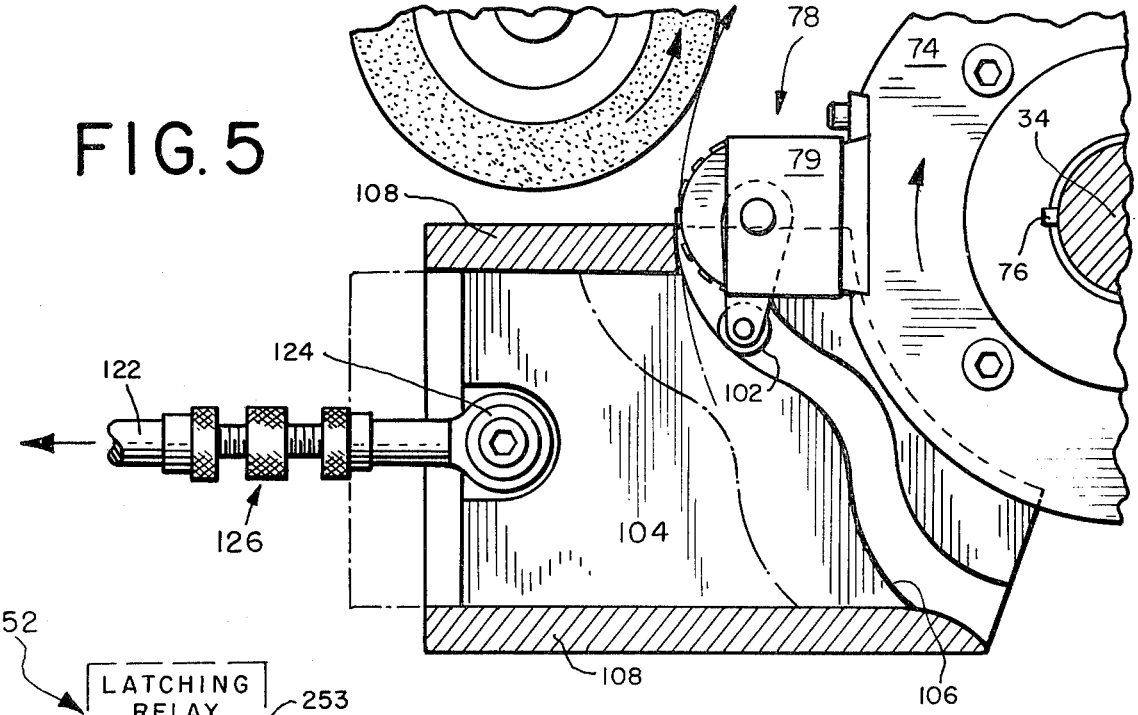
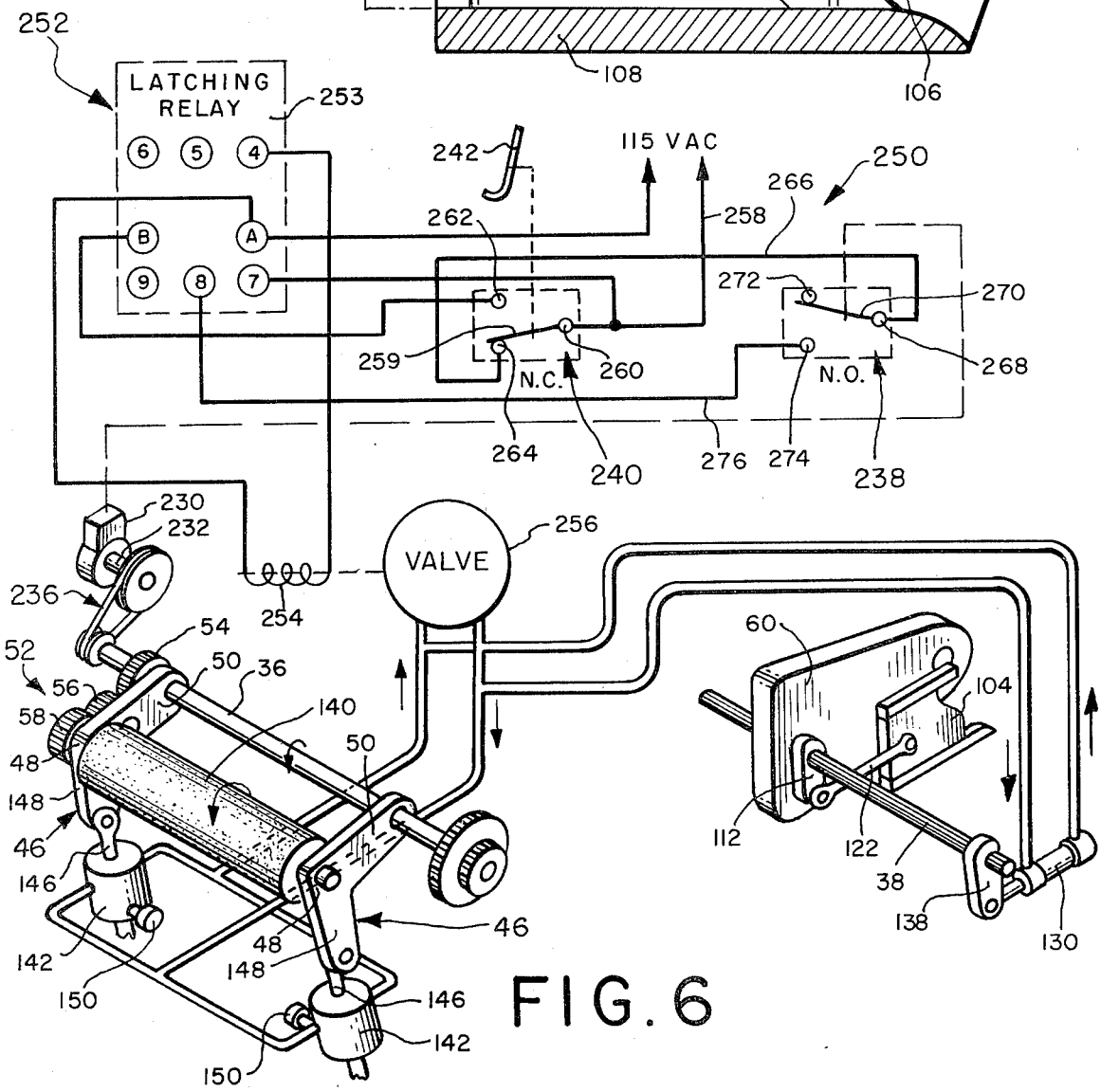
FIG. 6

HIGH SPEED MARKING APPARATUS

BACKGROUND OF THE INVENTION

1. Field of the Invention

The present invention relates to a high speed rotary marking apparatus for use with a high speed printing machine. More specifically, the invention relates to an apparatus which has an axially and rotationally adjustable numbering unit for use in marking selected numbers on sheets of material exiting from a high speed printing machine.

2. Description of the Prior Art

Heretofore various mechanisms have been proposed for printing numbers on sheets of material exiting from a printing machine. Examples of such numbering mechanisms are disclosed in the following U.S. patents.

| U.S. PAT. NO. | PATENTEE |
|---|---|
| 381,105 | Black |
| 425,298 | Carlaw |
| 764,289 | Harris |
| 1,113,483 | Pritchard |
| 1,920,232 | Allen |
| 2,652,772 | Katz |
| 3,120,800 | Ward |
| 3,171,348 | Wetzer |

The Harris U.S. Pat. No. 764,289 discloses a numbering attachment for printing presses which includes discs mounting numbering heads that are adjustable longitudinally of the shaft on which they are held by means of a spline. Also, this patent teaches the use of a crank arm arrangement for changing the number.

In the Pritchard U.S. Pat. No. 1,113,483 there is disclosed a printing press including a numbering mechanism which can be utilized to print the same number but different dates on envelopes. The numbering mechanism is designed to change the date during each operation of the printing press while the number is only changed once in each cycle of operation of the dating mechanism.

Also, various devices have been proposed for changing the rotational position of a point on one rotating member relative to the rotational position of a point on another rotating member. Examples of such devices are disclosed in the following U.S. patents.

| U.S. PAT. NO. | PATENTEE |
|---|---|
| 2,030,027 | Greenwood |
| 2,245,075 | Mingle |
| 3,166,947 | Hendershot |
| 3,364,789 | Whitfield |
| 3,385,125 | Plumb |
| 3,516,297 | Dullinger |
| 3,525,305 | Daniels |
| 3,563,104 | Schuster |
| 3,630,145 | Leuenberger |
| 3,750,568 | Weisgerber |
| 3,906,810 | Glendening |

As will be described in greater detail hereinafter, the high speed marking apparatus of the present invention differs from the previously proposed numbering mechanisms by providing therein a rotatable indicia marking mechanism which is not only axially adjustable but is also rotationally adjustable, so that the time of, and the position of, the marking of indicia on a sheet of material relative to the time of the printing on the sheet of material can be adjusted. Moreover, the marking apparatus of the present invention includes an impression roller and control mechanisms for controlling the positioning of the impression roller to engage a sheet of material coming out of the printing mechanism beneath the path of travel of the indicia marking mechanism. Still further, the apparatus of the present invention includes a caam mechanism for selectively advancing the indicia positioned for marking to a next indicia in timed relationship to the positioning of the impression roller.

In a specific embodiment of the apparatus of the present invention, the axial adjustment as well as the rotational adjustment of the indicia marking unit can be made during operation of the apparatus.

SUMMARY OF THE INVENTION

According to the invention there is provided a high speed marking apparatus which is used with, and positioned at the exit end of, a high speed printing machine having a cylindrical printing plate on a rotatably driven shaft, said apparatus comprising a framework adapted to be mounted to the exit end of the machine, a first shaft rotatably journalled to said framework, indicia marking means axially adjustable on and rotatable with said first shaft for marking selected indicia on material exiting from the machine, said indicia marking means including indicia changing means for changing the indicia and actuating means for selectively actuating said indicia changing means to change said indicia after a selected number of revolutions of said first shaft, a second shaft rotatably journalled to said framework parallel to said first shaft, a third shaft, means for pivotally mounting said third shaft to said second shaft, an impression roller mounted on said third shaft, means for drivingly coupling said second shaft to said third shaft, moving means for moving said impression roller between a lower retracted position and a raised position where a tangent on the cylindrical periphery of said impression roller is tangent with the circular path of travel of said indicia marking means whereby material exiting the machine is carried by said impression roller past said indicia marking means for the marking of indicia thereon, drive train means coupled between the driven shaft mounting the cylindrical printing plate of the printing machine and said first and second shafts of said apparatus for driving said first and second shafts in timed relationship to the printing on the material by the cylindrical printing plate, said drive train means including timing means for adjusting the time of, and the position of, the marking of indicia on the material relative to the time of printing on the material by the printing plate, control means for controlling the operation of the actuating means and said roller moving means and positioning means for adjusting the axial position of said indicia marking means on said first shaft.

BRIEF DESCRIPTION OF THE DRAWINGS

FIG. 5 is an enlarged fragmentary view of a portion of FIG. 3 and shows the numbering unit and a cam follower mounted therewith travelling past the cam surface of a cam mechanism of the high speed marking apparatus.

FIG. 6 is a partially schematic, partially perspective view of the electrical and pneumatic control circuits for moving a cam plate of the cam mechanism of the high speed marking apparatus and an impression roller of the high speed marking apparatus.

DESCRIPTION OF THE PREFERRED EMBODIMENT

Figure 1:
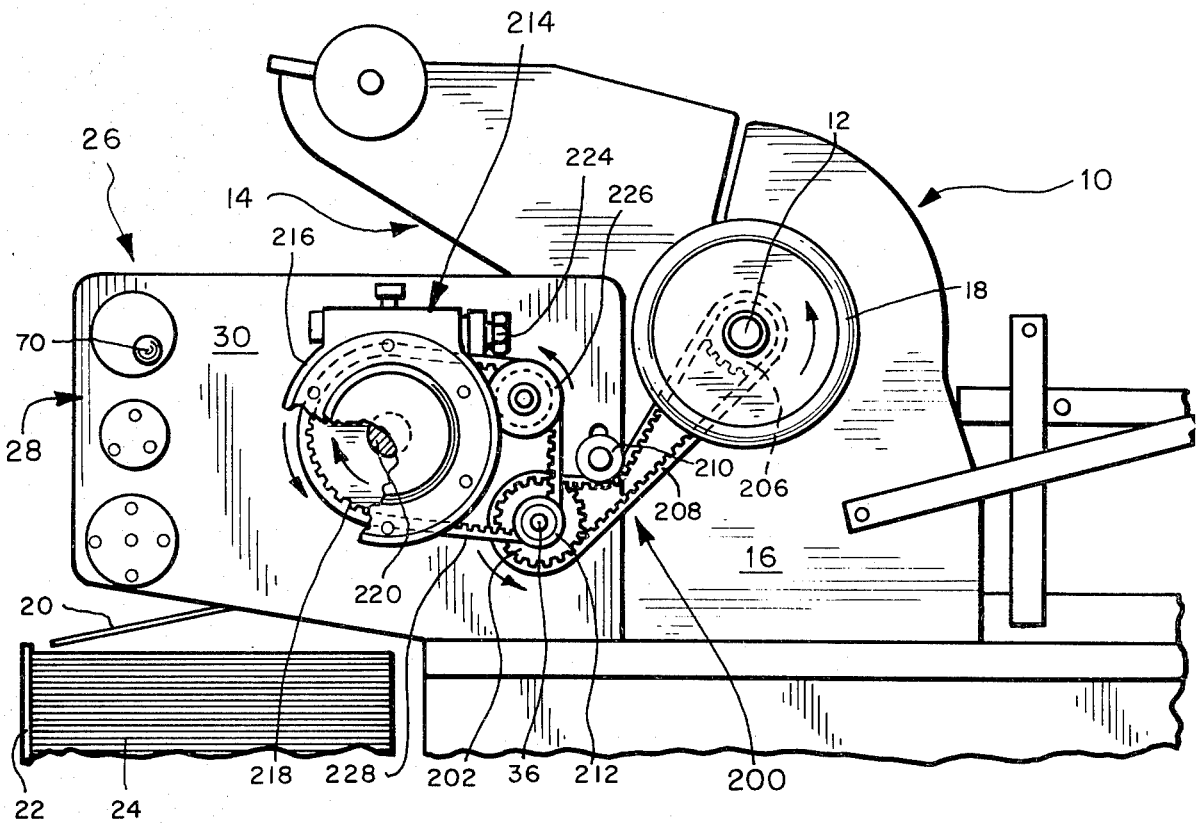
FIG. 1 is a side elevational view of the high speed marking apparatus of the present invention mounted to the exit end of a high speed printing machine.

Referring to FIG. 1, there is illustrated therein a high speed printing machine 10 of conventional design which includes a cylindrical printing plate (hidden from view) mounted on a shaft 12 at the exit end 14 of the machine 10 defined between spaced apart sidewalls 16 of the machine 10. The shaft 12 also has an end thereof extending from one sidewall 16 on which is mounted a handwheel 18 for manually rotating the cylindrical printing plate hidden from view.

Sheets 20 of paper or other material printed by the printing machine 10 come out of the exit end 14 and fall into a bin 22 wherein a stack 24 of the printed sheets is held.

According to the teachings of the present invention, a high speed marking apparatus 26 is positioned between the exit end of the printing machine 10 and the bin 24. The high speed marking apparatus 26 includes a framework 28 having two end plates 30 and 32 (FIG. 2) which, in the illustrated embodiment, are attached, respectively, to the sidewalls 16 of the printing machine 10.

Figure 2:
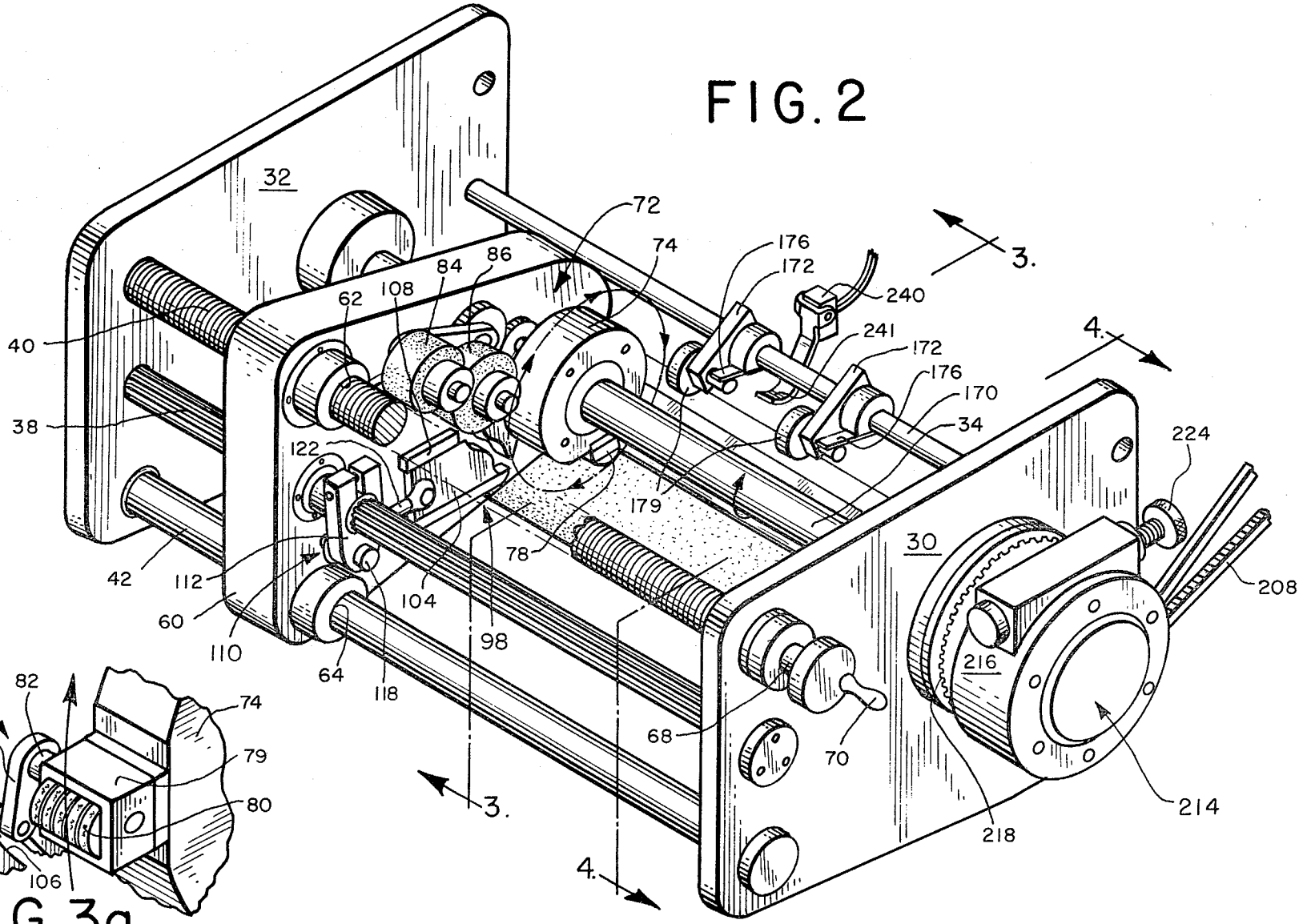
FIG. 2 is a perspective view of the high speed marking apparatus of the present invention viewing the same from an upper corner thereof.
Figure 3A:
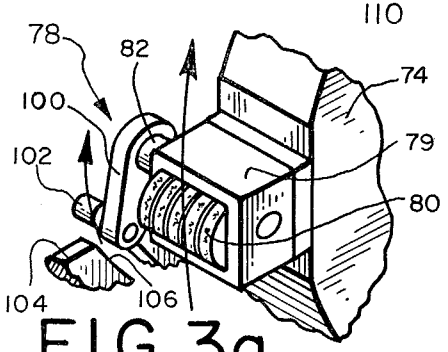
FIG. 3A is a fragmentary perspective view of a numbering unit of the indicia marking mechanism shown in FIG. 3 and is shown on the second sheet of drawings with FIG. 2.
Figure 3:
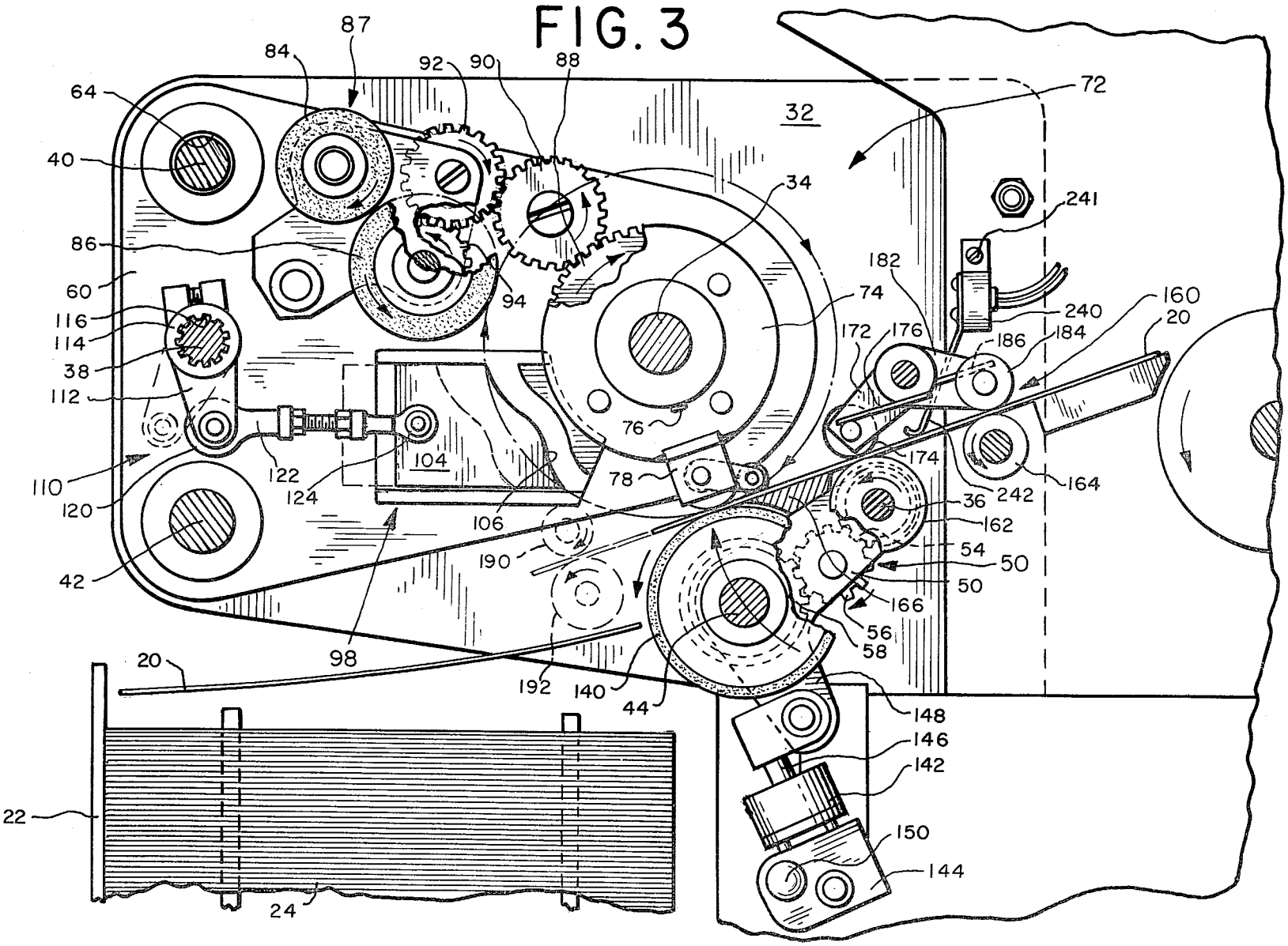
FIG. 3 is a vertical sectional view taken along line 3—3 of FIG. 2 and shows the indicia marking mechanism of the high speed marking apparatus.

The framework 28 further includes a plurality of shafts (FIG. 3) which are rotatably journalled to and between the end plates 30 and 32. These shafts are identified as follows: a first driven shaft 34, a second driven shaft 36, a splined shaft 38 and a threaded shaft 40. The framework 28 also includes a guide shaft 42 fixed between the end plates 30 and 32 as best shown in FIGS. 2 and 3.

The apparatus 26 also includes a third driven shaft 44 which is rotatably journalled between a pair of L shaped brackets 46. As best shown in FIG. 6, the third shaft 44 is mounted between corners 48 of the L shaped brackets 46 and the outer end of one leg 50 of each of the brackets 46 is pivotally mounted on the second shaft.

Also, as shown in FIG. 6, a drive train 52 comprising a drive gear 54 fixed on the second shaft 36, an idler gear 56 mounted to one of the brackets 46 and a driven gear 58 fixed on one end of the second shaft 36 is provided for rotating the third shaft 44.

Referring again to FIG. 2, the apparatus 26 includes a frame member 60 which is movably mounted on the first driven shaft 34, the threaded shaft 40, the splined shaft 38 and the guide shaft 42. The frame member 60 has a threaded bore 62 in which the threaded shaft 40 is received, a bore 64 through which the guide shaft 42 extends, a bore (hidden from view) through which the splined shaft 38 extends and, a bore (hidden from view) through which the first driven shaft 34 extends.

An outer end 68 (FIG. 2) of the threaded shaft 40 extends through the end plate 30 and has a handle 70 mounted thereon. It will be appreciated that by turning the handle 70 to rotate the threaded shaft 40, the frame member can be adjustably positioned on and axially of the first driven shaft 34, the splined shaft 38 and the guide shaft 42.

Referring now to FIGS. 2, 3 and 5, the high speed marking apparatus 26 includes an indicia marking mechanism 72 comprising a cylindrical head 74 which is rotatably journalled to the frame member 60 adjacent the bore therein through which the first driven shaft 34 extends. The cylindrical head 74 is axially slidable on and rotatable with the first driven shaft 34 by means of a key or spline 76.

Fixed on the outer periphery of the cylindrical head 74 is a numbering unit 78 of conventional design. As best shown in FIG. 3*a* the numbering unit 78 includes a housing 79, a plurality of discs 80 on a rod (not shown) within the housing 79, each disc 80 having a series of numbers thereon. Also, the numbering unit 78 has a conventional ratchet mechanism (not shown) therein and an actuating rod 82 extending from the housing 79 for actuating the ratchet mechanism.

The indicia marking mechanism 72 further includes an ink roller 84 rotatably journalled to the frame member 60 and a transfer roller 86 positioned to engage the ink roller 84 and having a tangent thereof tangent with the circular path of travel of the number exposed by the numbering unit 78 for marking, as best shown in FIG. 3. Also, the indicia marking mechanism 72 includes a drive train 87 (FIG. 3) consisting of a drive gear 88 rotatably journalled with the cylindrical head 74 about the bore through which the first driven shaft 34 extends and rotatable with the cylindrical head 74, a first transfer gear 90 engaging the drive gear 88, a second trasfer gear 92 in meshing engagement with said first transfer gear 90 and a driven gear 94 fixed to the transfer roller 86. The transfer roller 86 and the transfer gears 90 and 92 are rotatably journalled to the frame member 60 and two transfer gears 90 and 92 are utilized in order to drive the transfer roller 86 in a rotational direction opposite the direction of rotation of the cylindrical head 74. With this arrangement, ink is continually applied to the transfer roller 86 during operation of the marking apparatus 26 so that fresh ink is available to the number exposed by the numbering unit 78 upon each rotation of the cylindrical head 74.

The indicia marking mechanism 72 of the high speed marking apparatus 26 also includes a cam mechanism 98 comprising an arm 100 (FIG. 3*a*) mounted to the ratchet operating rod 82 of the numbering unit 78 and a cam follower 102 on the outer end of the arm 100.

The cam mechanism 98 also comprises a cam plate 104 (FIG. 3) having an undulated cam surface 106 on one edge thereof. The cam plate 104 is positioned for horizontal movement within a track 108 fixed to the frame member 60. A crank mechanism 110 comprising a first arm 112 has one end 114 rotatably journalled to the frame member 60 about the splined shaft 38. An opening 116 in the one end 114 has grooves for mating with the splines on the splined shaft 38 so that the one end 116 is slidable on the splined shaft 38 and rotatable therewith. An outer end 118 of the first arm 112 is pivotally connected to one end 120 of a second arm 122 and the other end 124 of the second arm 122 is pivotally connected to the cam plate 104. Also, as best shown in FIG. 5, the second arm 122 includes a knurled nut and threaded rod arrangement 126 to provide a "fine" adjustment of the length of the second arm 122 to adjust the extended position of the cam surface 106 on the one edge of the cam plate 104.

It will be apparent from FIG. 3 that the crank arm mechanism 110 is utilized for moving the cam plate 104 between an extended position shown solid in FIG. 3 where the cam surface 106 is in position to be engaged by the cam follower 102 carried by the numbering unit 78 and a retracted position shown in phantom where the cam surface 106 is out of the path of movement of the cam follower 102. Accordingly, when the cam plate 104 is in the extended position, the cam follower 102 will engage the cam surface 106 and will be moved radially inwardly of the axis of rotation of the first driven shaft 34 to "ratchet" the numbering unit 78 to advance or index the next succeeding number available in the numbering unit 78 to the marking position which is the position most radially outwardly from the first driven shaft 34.

Figure 4:
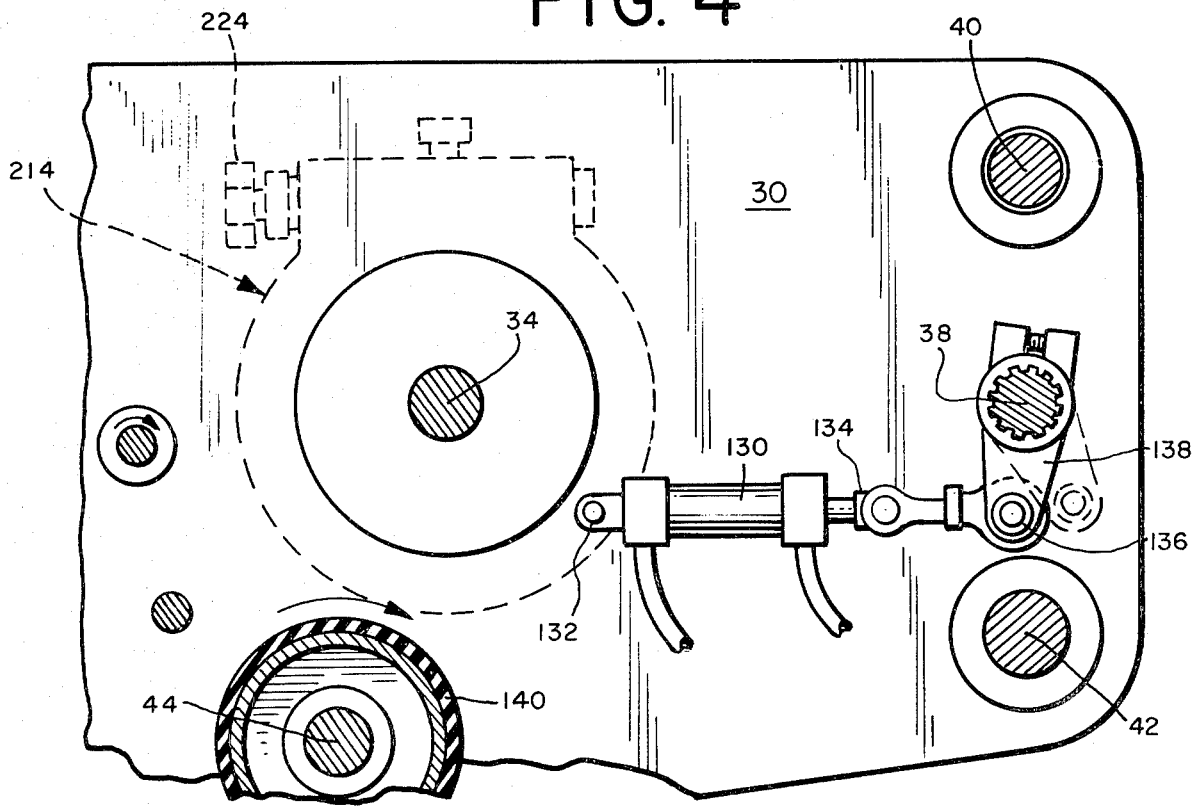
FIG. 4 is a vertical sectional view taken along lines 4—4 of FIG. 2, shows the mechanism for rotating a splined shaft of the high speed marking apparatus and is shown on the first sheet of drawings with FIG. 1.

As shown in FIG. 4, a pneumatic piston and cylinder assembly 130 has one end 132 which is fixed to the end plate 30 and a movable end 134 which is pivotally connected to an outer end 136 of an arm 138 that is fixed to the splined shaft 38. As will be explained in greater detail in connection with the description of FIGS. 3 and 6, the piston and cylinder assembly 130 is actuated at predetermined times to rotate the splined shaft 38 to move the cam plate 104 between its extended position and its retracted position and to hold the cam plate 104 in one or the other of those positions for predetermined periods of time by electric and pneumatic control mechanisms.

Referring now to FIGS. 3 and 6, the third shaft 44 driven by the second shaft 36 has an impression roller 140 mounted thereon. As shown in FIG. 6, an arrangement comprising a pair of pneumatic piston and cylinder assemblies 142 each having one end 144 (FIG. 3) fixed to the printing machine 10 and a movable end 146 pivotally connected to the outer end of a second arm 148 of respective ones of the L shaped brackets 46 is provided for moving the impression roller 140. As will be described in greater detail hereinafter, each of the pneumatic piston and cylinder assemblies 142 is operable to move the impression roller 140 between a retracted position (not shown) and an extended position shown in FIG. 3 where a tangent on the periphery of the impression roller 140 is tangent to the circular path of movement of the number exposed for marking on the numbering unit 78. In this way and as best shown in FIG. 3, when a sheet 20 of paper passes through the marking apparatus 26, the impression roller 140 on the third shaft 44 will provide a support and backing for the printing of a number on a sheet 20 of paper as it passes between the number on the numbering unit 78 and the impression roller 140.

The second shaft 44 is driven so that power transmission from the drive gear 54 on the second shaft through the idler gear 56 to the driven gear 58 on the third shaft 44 is such as to drive the impression roller in a rotational direction which is opposite to the direction of rotation of the cylindrical head 74 rotated by the first shaft 34. Further, the shaft 44 is driven at a speed such that the peripheral velocity of the roller 140 matches the peripheral velocity of the numbering unit 78, and the linear velocity of the sheets 20 of paper exiting the machine 10. Also, and as shown in FIGS. 3 and 6, each of the piston and cylinder assemblies 142 has a knob 150 by which the extent of the movable end can be adjusted to provide a mechanical "fine" adjustment of the position of the impression roller 140.

The high speed marking apparatus 26 further includes a sheet guide assembly 160 which includes a guide roller 162 mounted on the second shaft 36 for rotation therewith and which is positioned to cooperate with a guide roller 164 at the exit end of the printing machine 10. As a sheet 20 of paper exits from the printing machine 10, it is carried over the guide roller 164 of the printing machine 10 to the guide roller 162 on the second driven shaft 36. From there it passes over a guide plate 166 which is shown in FIG. 3 and omitted from FIGS. 2 and 6 and which is mounted between the end plates 30 and 32 and between the guide roller 162 and the impression roller 140 for guiding the sheet 20 of paper onto a tangent to both the circular path of movement of the exposed number on the numbering unit 78 and the impression roller 140.

The guide assembly 160 further includes a fixed rod 170 mounted to and between the end plates 30,32 above the guide roller 162. Pivotally mounted on the fixed rod are a pair of brackets 172 each mounting a short roller 174 at the end thereof. Also attached to the rod 170 adjacent each bracket 172 is a leaf spring 176 for urging each roller 174 downwardly toward the guide roller 162. Additionally, the guide assembly 160 includes a second pair of brackets 182 pivotally mounted to the rod 170 with each bracket 182 having a short roller 184 mounted on the end thereof. Each roller 184 is biased by a leaf spring 186 downwardly toward the guide roller 164 at the end of the printing machine 10. It will be apparent that the guide roller 162 and the guide plate 166, and the two pairs of short rollers 174 and 184 to facilitate the feeding of a sheet 20 of paper from the printing machine 10 into the marking apparatus 26.

If desired, the sheet guide assembly 160 can also include a pair of roller 190,192 one of which is driven, shown in phantom positioned downstream of the path of travel of the sheets 20 of paper from the impression roller 140 and cylindrical head 74.

Referring now to FIG. 1, the high speed marking apparatus 26 further includes a drive train arrangement 200 comprising a toothed pulley 202 on one end of the second driven shaft 36 which extends through the end plate 30. A similar toothed pulley 206 is mounted on the shaft 12 of the printing machine 10 on which shaft 12 is mounted the cylindrical printing plate not shown. The two toothed pulleys 202 and 206 are coupled by a continuous toothed belt 208 having resilient teeth thereon. An adjustable tensioning pulley 210 is mounted on the end plate 30 and positioned to be brought into engagement against the outer surface of the continuous belt 208 for placing tension thereon.

The drive train arrangement 200 further includes a smaller toothed pulley 212 on the second shaft 36, and a timing unit 214 having a housing 216 which is mounted to the end plate 30 and having a large diameter input gear 218 positioned between the housing 216 and the end plate 30. The timing unit 214 also includes an output shaft 220 coaxial with the input gear 218 extending from the same side of the housing 216 of the timing unit 214 where the larger diameter input gear 218 is located. This output shaft 220 is directly coupled to the first driven shaft 36 of the apparatus 26 for driving same.

The timing unit 214 also includes a manual adjustment knob 224 by which the relative rotational position of the input gear 218 relative to the rotational position of the output shaft 220 can be adjusted. The gear mechanisms within the timing unit 214 can be of the type disclosed in U.S. Pat. No. 3,563,104 and/or in U.S. Pat. No. 2,030,027. This adjustment can be made during operation or inoperation of the high speed marking apparatus 26 and the high speed printing machine 10. Also provided as part of the drive train arrangement 200 is an idler pulley 226 and a continuous toothed belt 228 which is trained over the small diameter pulley 212 on the second driven shaft 36, the idler pulley 226 and the large diameter input gear 218 of the timing unit 214.

Referring now to FIG. 6 there is illustrated therein a rotary cam mechanism 230 mounted on a timing shaft 232 which is coupled by means of a belt and pulley arrangement 236 to the second driven shaft 36. Upon each revolution of the shaft 232, the rotary cam assembly 230 is operated to close a cam switch 238 for 20° of the revolution and to open the cam switch 238 for 340° of the revolution of the timing shaft 232.

As shown in FIG. 3, a sensing switch 240 depends from a thin rod 241 mounted to the end plates 30 and 32 of the machine 10. The sensing switch 240 has a sensing arm 242 which depends between the short rollers 184 into the path of movement of a sheet 20 of paper exiting from the printing machine 10. When the sheet 20 of paper hits the sensing arm 242, the sensing switch 240 which is normally closed, is opened.

Referring again to FIG. 6, an electrical circuit 250 including the sensing switch 240 and the cam switch 238 includes a latching relay circuit 252 which is of the type which includes a terminal block 253 having a latching relay mounted thereon for energizing a solenoid coil 254 to operate an air valve 256 (or, if desired, solenoids utilized in place of the piston and cylinder assemblies 130 and 142) which controls the supply of air pressure to or from the pneumatic piston and cylinder assembly 130 for operating the cam mechanism 98 (FIG. 2) and the pneumatic piston and cylinder assemblies 142 for moving the impression roller 140 upwardly and downwardly. The latching relay circuit 252 is of the type sold by Potter and Brumfield of Princeton, Ind. under model no. Kul 11A15. The coil 254 is connected to the terminals A and 4 of the latching relay terminal block 253 and is set so that when the coil 254 is de-energized, the air valve is opened to hold the impression roller 140 in the raised position and to hold the cam plate 104 in the extended position. To achieve this function, the terminal A of the latching relay terminal block 253 is connected to one side of the AC source and to one side of the coil 254. The other side of the AC source is connected via line 258 to terminal 7 of the terminal block 253 and to a terminal 260 of the sensing switch 240. As shown, the sensing switch 240 is a single pole double throw switch having a movable switch blade 259 and the common terminal 260 which is connected to line 258. One terminal 262 thereof is connected to terminal B of the terminal block 253 and this terminal B is open circuited so that when the blade 259 of the sensing switch 240 connects terminals 260 and 262, switch 240 is opened. Another terminal 264 of the switch 240 is connected to a conductor 266 which in turn is connected to a terminal 268 of the cam switch 238. Since for 340° of a revolution of the timing shaft 232 the cam switch 238 is open, the cam switch 238 is shown in FIG. 6 with a movable switch blade 270 thereof connected between the common terminal 268 and an open terminal 272. The cam switch 238 is also a single pole double throw switch and a second pole or terminal 274 thereof is connected via a conductor 276 to terminal 8 of the latching relay terminal block 253. Terminal 8 is connected internally inside the terminal block 253 to terminal 4 for energizing the coil 254 when the sensing switch 240 is closed as shown and the cam switch is moved from its normally open position to its closed position.

In the operation of the high speed marking apparatus 26 the wheel handle 70 (FIG. 2) is rotated until the frame member 60 is at an appropriate position for the proper horizontal position of the numbering unit 78 relative to a sheet 20 of paper exiting from the printing machine 10. Then, after a few sheets 20 of paper are run through the high speed marking apparatus 26, the timing unit 214 is adjusted to adjust the position of the number on each sheet 20 of paper lengthwise of the sheet of paper. Once these positions are determined, the high speed marking apparatus 26 is then set to print consecutive numbers on sheets 20 of paper exiting from the printing machine 10. Of course, if desired, the location of the number can be adjusted both lengthwise of the sheet 20 of paper (by manipulating knob 224) and widthwise of the sheet 20 of paper (by manipulating handle 70) during the operation of the high speed marking apparatus 26.

During operation of the high speed marking apparatus 26, as a sheet 20 of paper exits from the printing machine 10, it engages the sensing arm 242 of the sensing switch 240 to move the switch 242 from a normally closed position to a normally open position. When this occurs there is an open circuit condition and the coil 254 is de-energized and maintained de-energized so as to maintain the cam surface 106 of the cam plate 104 in position to be engaged by the cam follower 102 on each rotation of the first driven shaft 34. Likewise the pneumatic piston and cylinder assemblies 142 are maintained in the extended position to hold the impression roller 140 in the raised position so that up and down movement of the piston rods of these assemblies 142 (and the impression roller 140) is avoided.

However, if a sheet 20 of paper does not come through, the normally closed sensing switch will remain closed and the cam switch will be closed through 20° of a revolution of the timing shaft 232. This 20° of closure is sufficient to cause energization of the latching relay that is of the type which then will latch in the energized position until the circuit through switches 238 and 240 is open circuited for a predetermined period of time which is a greater period of time than the time it takes for the timing shaft 232 to rotate 340°. This of course is also dependent upon the speed of rotation of the shaft 12 of the printing machine. When this happens, of course, the cam plate 104 is retracted so the number is not advanced and the impression roller 140 is moved to its retracted position so that it will not be engaged by the exposed number of the numbering unit 78 mounted on the cylindrical head 74.

However, once a sheet 20 of paper again comes through the high speed marking apparatus 26, the circuit through the sensing swith 240 and the cam switch 238 will be open for a greater period of time than the time it takes for the timing shaft 232 to rotate 340+ and a time sufficient to cause unlatching of the latching relay and de-energization thereof so that the cam plate 104 can be moved to its extended position and the impression roller 140 can be moved to its raised position.

From the foregoing description it will be apparent that the high speed marking apparatus 26 of the present invention has a number of advantages, some of which have been described above and others of which are inherent in the invention. In particular, the high speed marking apparatus 26 provides a relatively simple and very flexible apparatus for imprinting consecutive numbers on successive sheets of paper 20 exiting from a high speed printing machine 10. The apparatus 26 can also be used for scoring or perforating sheets 20. Also with respect to flexibility, the position of the number can be adjusted during operation of the printing machine and the marking apparatus 26 both lengthwise of each each sheet 20 of paper and widthwise of each sheet 20 of paper exiting from the printing machine 10.

From the foregoing description it will also be apparent that obvious modifications and variations can be made to the high speed marking apparatus 26 of the present invention without departing from the teachings of the invention. For example, suitable control circuitry could be coupled to the electrical circuit 250 and more specifically to the sensing switch 240 for causing a single number to be printed on each sheet 20 of paper until a certain number of sheets 20 of paper have been printed with that number and then the cam plate 104 can be extended to cause advancement of the number followed by retraction of the cam plate 104 for another count of sheets of paper being printed. Also the handle 70 and the knob 224 can be electrically operated, additional numbering units 78 can be mounted on the head 74, an electric "eye" sensing arrangement can be used instead of sensing switch 240 and modified electronic controls can be provided for controlling marking on a web of material or envelope.

Another modification would be the provision of another frame member and associated indicia marking mechanism and cam assembly. With such a modified embodiment, the guide shaft 42 would be replaced by a threaded shaft and such threaded shaft would be slidably received through the bore 64 but would be threadingly received through a similar bore in the additional frame member. Likewise the threaded shaft 40 would be slidably received through a bore in the additional frame member so that one frame member would slide on one threaded shaft and the other frame member would slide on the other threaded shaft. In this way, two adjustably positionable numbers can be imprinted on each sheet 20 of material exiting from the high speed printing machine 10.

Inasmuch as various modifications and variations can be made to the apparatus 26 of the present invention as noted above without departing from the teachings of the present invention, the scope of the present invention is only to be limited as necessitated by the accompanying claims.

We claim:

1. A high speed marking apparatus which is used with, and positioned at the exit end of, a high speed printing machine having a cylindrical printing plate on a rotatably driven shaft, said apparatus comprising a framework adapted to be mounted to the exit end of the machine, a first shaft rotatably journalled to said framework, indicia marking means axially adjustable on and rotatable with said first shaft for marking selected indicia on material exiting from the machine, said indicia marking means including indicia changing means for changing the indicia and actuating means for selectively actuating said indicia changing means to change said indicia after a selected number of revolutions of said first shaft, a second shaft rotatably journalled to said framework parallel to said first shaft, a third shaft, means for pivotally mounting said third shaft to said second shaft, an impression roller mounted on said third shaft, means for drivingly coupling said second shaft to said third shaft, moving means for moving said impression roller between a lower retracted position and a raised position where a tangent on the cylindrical periphery of said impression roller is tangent with the circular path of travel of said indicia marking means whereby material exiting the machine is carried by said impression roller past said indicia marking means for the marking of indicia thereon, drive train means coupled between the driven shaft mounting the cylindrical printing plate of the printing machine and said first and second shafts of said apparatus for driving said first and second shafts in timed relationship to the printing on the material by the cylindrical printing plate, said drive train means including timing means for adjusting the time of, and the position of, the marking of indicia on the material relative to the time of printing on the material by the printing plate, control means for controlling the operation of the actuating means and of said roller moving means, and positioning means for adjusting the axial position of said indicia marking means on said first shaft.

2. The apparatus according to claim 1 wherein said indicia marking means include a cylindrical member axially slidable on and rotatable with said first shaft and a numbering unit mounted on said cylindrical member.

3. The apparatus according to claim 2 wherein said numbering unit includes a plurality of discs mounted on a rod within said numbering unit, each disc having a plurality of numbers thereon, one of which is position on said circular path of movement of said indicia marking means for marking on a sheet of material.

4. The apparatus according to claim 3 wherein said indicia changing means include ratchet means associated with said rod within said numbering unit for advancing the number positioned for marking by the numbering unit, an arm mounted at one end to said ratchet means and a cam follower mounted on an outer end of said arm.

5. The apparatus according to claim 4 wherein said actuating means include a cam plate having a cam surface on one end thereof which can be positioned in the path of movement of said cam follower as said numbering unit is rotated about said first shaft.

6. The apparatus according to claim 5 wherein said cam surface is an undulated surface.

7. The apparatus according to claim 5 wherein said framework includes a guide shaft journalled to said framework, said indicia marking means include a frame member adjustably positioned on and axially of said first shaft and said guide shaft and said actuating means include a track on said frame member, said cam plate being mounted for reciprocal movement within said track, and cam plate moving means for moving said cam plate on said track between a retracted position where said cam surface is out of the circular path of movement of said cam follower and an actuating position where said cam surface is in said path of movement of said cam follower.

8. The apparatus according to claim 7 wherein said cam plate moving means for moving said cam plate include a fourth shaft which is journalled to said framework, said frame member having an opening through which said fourth shaft extends, a crank arm assembly comprising a first arm having one end rotatably journalled on said frame member and slidable axially on and rotatable with said fourth shaft and a second arm having one end pivotally connected to said first arm and another end pivotally connected to said cam plate, said crank arm assembly also including mechanical fine adjustment means for adjusting the length of said second arm, a drive arm fixed at one end on said fourth shaft and reciprocal power means having a movable end pivotally connected to an outer end of said drive arm and a fixed end fixed to said framework, said reciprocal power means being operated by said control means.

9. The apparatus according to claim 8 wherein said control means include a switch having a switch actuating arm mounted to extend into the path of movement of sheets of material exiting from the printing machine, said control means being operable upon actuation of said switch a predetermined number of times by a predetermined number of sheets of material exiting from the machine to cause operation of said reciprocal power means to move said cam plate into position to cause said cam follower to engage said cam surface to operate said ratchet mechanism of said numbering unit to advance said number positioned for marking to the next succeeding number and said control means also being operative at the same time to cause said moving means to move said roller upwardly.

10. The apparatus according to claim 9 wherein said predetermined number is "one" so that upon each actuation of said switch said cam plate is advanced to engage said cam follower to cause a succeeding number to be positioned for marking by the numbering unit and marked on the sheet of material.

11. The apparatus according to claim 8 wherein said reciprocal power means are a pneumatic piston and cylinder assembly.

12. The apparatus according to claim 2 wherein said framework includes a guide shaft journalled to said framework and wherein said indicia changing means include a frame member positioned on and axially adjustable on said first shaft and said guide shaft, said cylindrical member being rotatably journalled to said frame member about said first shaft and rotatable with said first shaft, an ink roller rotatably mounted on said frame member, a transfer roller rotatably mounted on said frame member, said transfer roller engaging said ink roller and having a tangent on the cylindrical surface thereof tangent with said circular path of movement of a number of said numbering unit positioned for marking on a sheet of material and drive means on said frame member for drivingly coupling said first shaft with said transfer roller to drive same in a rotational direction opposite the direction of rotation of said numbering unit.

13. The apparatus according to claim 1 wherein said framework includes opposed end plates which are fixed to the exit end of the printing machine, said first and second shafts being rotatably journalled to and between said end plates, a guide shaft which is journalled to and between said end plates and wherein said indicia marking means include a frame member which is positioned on and axially slidable on said shafts.

14. The apparatus according to claim 13 wherein said frame member has an opening therethrough which is threaded and wherein said positioning means include a threaded shaft which is rotatably journalled to and between said end plates and which extends through said threaded opening in said frame member, one end of said threaded shaft extending through one of said end plates, and wherein a handle is mounted on one end of said threaded shaft for rotating said threaded shaft thereby to adjust the position of said frame member between said end plates during operation or inoperation of said apparatus.

15. The apparatus according to claim 1 wherein said means for pivotally mounting said third shaft to said second shaft include two spaced apart L shaped brackets each having one end pivotally mounted on said second shaft and wherein a movable portion of said moving means is mounted to the other end of each of said brackets and a fixed portion of said moving means is fixed to the exit end of the printing machine.

16. The apparatus according to claim 15 wherein said moving means include two pneumatic piston and cylinder assemblies each having one end fixed to said framework and another end fixed to said other end of one of said brackets.

17. The apparatus according to claim 15 wherein said moving means include mechanical fine adjustment means for adjusting the extended position of said movable portion relative to said fixed portion of said moving means.

18. The apparatus according to claim 1 including sheet guide means mounted to said framework for guiding sheets of material into said apparatus and comprising a guide roller fixed on said second shaft for rotation therewith and a guide plate positioned adjacent said guide roller on the side thereof furthest from the machine.

19. The apparatus according to claim 18 wherein said guide means include a fixed shaft mounted to said framework above said guide roller and having pivotally mounted thereto a pair of brackets each mounting a short roller on the other end thereof and each having spring means associated therewith for biasing said short roller toward said guide roller on said second shaft.

20. The apparatus according to claim 18 wherein said guide means further include a second pair of brackets mounted to said fixed shaft and a second pair of short rollers mounted to the outer end of each one of said second brackets and each bracket having spring means associated therewith for biasing said second pair of short rollers downwardly toward a guide roller at the exit end of the printing machine.

21. The apparatus according to claim 20 wherein said control means include a sensing switch which is mounted to said framework and which has a sensing arm extending therefrom, said sensing arm extending into the space between said first and second pairs of short rollers for sensing a sheet of material as it is guided from the exit end of the printing machine into said high speed marking apparatus.

22. The apparatus according to claim 21 wherein said control means include a rotary cam mounted in a predetermined position on said second shaft, a limit switch positioned in the path of said rotary cam and a latching relay for operating said moving means electrically coupled in series with said sensing switch, said limit switch, and a source of electric power, said limit switch being opened by said rotary cam for a predetermined time period during a portion of each rotation of said second shaft and said sensing switch being opened when a sheet of material passes beneath said sensing arm, said latching relay being operable to cause said moving means to move said impression roller to said raised position when said latching relay is de-energized by the opening of said sensing switch by sheets of material passing beneath said sensing arm and being operable to cause said moving means to move said impression roller to said retracted position when a sheet of material does not pass under said sensing arm and said limit switch is only closed for said predetermined time period thereby energizing said latching relay which latches in that position, and is maintained in that latched position by the closing of said limit switch for said predetermined time period on each revolution of said second shaft until said sensing switch is opened by a sheet of material passing therebeneath.

23. The apparatus according to claim 1 wherein an end of said first shaft and an end of said second shaft each extend from one side of said framework, and wherein said drive train means include a first pulley on said end of said second shaft, a continuous belt coupled between a pulley on the driven shaft of the cylindrical printing plate and said first pulley on said second shaft, a second smaller pulley also on said end of said second shaft, and wherein said timing means include a timing unit having a body fixed to said framework, a large diameter input gear, an output shaft coaxial with said input gear and directly coupled to said first shaft, and means within said body for adjusting the rotational position of said output shaft relative to the rotational position of said input gear, said drive train means further including a continuous belt coupling said second pulley with said large diameter input gear.

24. The apparatus according to claim 23 wherein said pulleys have teeth and said belts have cooperating flexible teeth to prevent slippage of said belts on said pulleys and said gear.

25. The apparatus according to claim 23 including an adjustable idler pulley mounted to said framework and movable against the outer surface of said continuous belt coupling the driven shaft of the printing machine with said second shaft of said apparatus.

26. The apparatus according to claim 23 wherein said drive train means include an idler pulley over which said second belt is trained.

27. The apparatus according to claim 23 wherein said timing unit rotates said first shaft in a rotational direction opposite to the direction of rotation of said second shaft.

28. The apparatus according to claim 23 wherein said large diameter gear of said timing unit is mounted between said body of said unit and said framework and on the same side of said timing unit from which said output shaft extends for connection to said first shaft.

29. The apparatus according to claim 23 wherein said large diameter input gear rotates in the opposite direction with respect to the direction of rotation of said output shaft.

* * * * *